United States Patent [19]

Sato

[11] 4,431,706

[45] Feb. 14, 1984

[54] HEAT SENSITIVE RECORDING SHEET

[75] Inventor: Masuhiko Sato, Tokyo, Japan

[73] Assignee: Jujo Paper Co., Ltd., Tokyo, Japan

[21] Appl. No.: 342,748

[22] Filed: Jan. 26, 1982

[30] Foreign Application Priority Data

Feb. 6, 1981 [JP] Japan ..... 56-15659

[51] Int. Cl.[3] ..... B41M 5/18

[52] U.S. Cl. ..... 428/537; 282/27.5; 428/320.8; 428/488; 428/913

[58] Field of Search ..... 282/27.5; 427/150, 151, 427/152; 428/320.8, 488, 913, 914, 411, 537

[56] References Cited

FOREIGN PATENT DOCUMENTS 53-5363 of 0000 Japan .
57-41994 3/1982 Japan ..... 346/209
57-116690 7/1982 Japan ..... 346/209
57-126693 8/1982 Japan ..... 346/208

OTHER PUBLICATIONS

Handbook of Chemistry and Physics, 31st ed., Chemical Rubber Pub. Co., Cleveland, OH., pp. 908 and 1080.

*Primary Examiner*—Bruce H. Hess
*Attorney, Agent, or Firm*—Koda and Androlia

[57] ABSTRACT

A heat sensitive recording sheet including dimethylterephthalate in its color-forming layer which contains a basic colorless or pale-colored chromogenic dyestuff and an organic color-developing agent whereby a heat sensitive recording sheet having a highly stable developed image against oily substances such as hair oil, sweat, etc. is provided without deteriorating the fundamental qualities of the heat sensitive recording sheet.

8 Claims, No Drawings

HEAT SENSITIVE RECORDING SHEET

BACKGROUND OF THE INVENTION

1. Field of the Invention

The present invention relates to a heat sensitive recording sheet having excellent color forming properties and high stability of the developed image against oily substances such as hair oil, sweat, etc.

2. Prior Art

A heat sensitive recording sheet that utilizes a thermal color-forming reaction occurring between colorless or pale-colored chromogenic dyestuff and phenolic material, or organic acid is disclosed, for example, in Japanese Patent Publication No. 4,160/1968 and No. 14,039/1970 and in Japanese Laid-Open Patent Application No. 27,736/1973 and is now in wide practical use.

In general, a heat sensitive recording sheet is produced by applying to the sheet surface a coating which is prepared by individually grinding and dispersing colorless chromogenic dyestuff and color-developing material, such as phenolic substance into fine particles, mixing the resultant dispersions with each other and then adding thereto binder, filler, sensitizer, slipping agent and other auxiliaries. When this sheet is heated, the coating instantly undergoes a chemical reaction which forms a color. In this case, various bright colors can be advantageously formed depending upon the selection of specific colorless chromogenic dyestuff.

These heat sensitive recording sheets have found a wide range of applications including medical or industrial measurement recording instruments, terminal printers for computers and information communication systems, facsimile equipment, printers for electronic calculators, automatic ticket vending machines and so on.

On the other hand, heat sensitive recording sheets come continuously into contact with human hands. At this time, oily substances such as hair oil, sweat, etc., adhering to the hands and fingers of the operators, often transfers to and contaminates the heat sensitive recording sheet. Generally, heat sensitive recording papers have not had sufficient stability against the oily substances so that there is a phenomenon that the color image density of contaminated parts is reduced or disappears and in that contamination of the background causes discoloration. Such a lack of stability against the oily substances is disadvantageous to the role and function of information recording paper.

Ideally, it is required that a heat sensitive recording paper develop a clear image, exhibit no recording problems due to the adhesion of accumulated residues onto the thermal head, sticking, etc., and has improved quality such as less decline in brightness with elapsed time. In addition, it is required that the heat sensitive paper have excellent stability of the recorded image and background against the oily substances such as hair oil, sweat, etc.. The reason why contamination due to hair oil, sweat, etc. causes the reduction of density or the disappearance of a developed image and the deterioration of the background is unknown, but it is assumed that such an oily substance is contained in hair oil, sweat, etc. will instabilize the reaction product of the chromogenic dyestuff and organic color-developing agent; and in the case of the background, the oily substance will instabilize the color-forming layer composed of chromogenic dyestuff and organic color-developing agent.

SUMMARY OF THE INVENTION

Accordingly, it is the general object of the present invention to provide a heat sensitive recording sheet which has a high stability of developed image against oily substances such as hair oil, sweat, etc. without deteriorating its fundamental qualities.

The above-mentioned object can be performed by adding dimethyl 1,4-benzenedicarboxylate into the color-forming layer containing a basic colorless or pale-colored chromogenic dyestuff and an organic color-developing agent.

DETAILED DESCRIPTION OF THE INVENTION

Although it is not clear why dimethylterephthalate causes stabilization of a developed image against oily substances, it is assumed that the dimethyl 1,4-benzenedicarboxylate is melted together into the melted color-forming substance to cause the stabilization of the developed image. Dimethyl 1,4-benzenedicarboxylate is a needle crystal and has a melting point of 140° C. and a boiling point of 288° C. and it is used as a raw material for the production of polyester synthetic fiber.

Another substance having a similar structure to dimethyl 1,4-benzenedicarboxylate is dimethyl 1,3-benzenedicarboxylate (dimethylisophthalate) which is described in Japanese Laid-Open Patent Application No. 5,636/1978 as a sensitizer. However, dimethylisophthalate has a melting point of between 67°–68° C. and a boiling point of 124° C., which are both lower than the melting point and boiling point of dimethyl 1,4-benzenedicarboxylate, respectively. The use of dimethylisophthalate with such physical properties will instabilize the quality of the product and extremely lower the production efficiency since the temperature of the dryers is limited to less than 67°–68° C. in the drying process after a coating.

The colorless or pale-colored dyestuffs of the present invention are not particularly limited and are, for example, as follows: crystal violet lactone (blue), 3-diethylamino-6-methyl-7-anilinofluoran (black), 3-(n-ethyl-p-toluidino)-6-methyl-7-anilinofluoran (black), 3-diethylamino-6-methyl-7-(o,p-dimethylanilino) fluoran (black), 3-pyrrolidino-6-methyl-7-anilinofluoran (black), 3-piperidino-6-methyl-7-anilinofluoran, 3-(n-cyclohexyl-n-methylamino)-6-methyl-7-anilinofluoran (black), 3-diethylaminio-7-(o-chloro-anilino) fluoran (black), 3-diethylamino-7-(m-trifluoromethylanilino) fluoran (black), 3-diethylamino-6-methylchlorofluoran (red), 3-diethylamino-6-methylfluoran (red), and 3-cyclohexylamino-6-chlorofluoran (orange).

On the other hand, examples of organic color-developing agents are organic carboxylic acids or phenols, such as bisphenol A, (4,4-isopropylidene diphenol), p,p-(1-methylnormal-hexylidene) diphenol, p-tertiary butylphenol, p-phenylphenol, Novolak phenolic resin, p-hydroxybenzoic acid esters and so on. Such organic color-developing agents are employed singly or together depending upon the usage and the required performance.

The above-mentioned organic color-developing materials, chromogenic dyestuffs and dimethylterephthalate are ground down to a particle size of several microns or smaller by means of a grinder or emulsifier such as a ball mill, attritor, sand grinder, etc. and in accordance with the purpose, various additives are added thereto to prepare coating colors. Such additives are as follows: binders such as polyvinylalcohol, modified polyvinylalcohol, hydroxyethyl cellulose, methyl cellulose, starches, styrene-maleic anhydride copolymer, vinyl-acetate-maleic anhydride-copolymer, styrene-butadiene-copolymer, etc.; inorganic or organic fillers such as kaolin, calcined kaolin, diatomaceous earth, talc, titanium dioxide, calcium carbonate, magnesium carbonate, aluminium hydroxide, etc.; if desired, releasing agent such as metal salts of fatty acids, etc.; slipping agent such as waxes, etc.; UV-absorbers such as benzophenone type or triazole type; water-resistance agent such as glyoxal, etc.; dispersants; anti-foamers; etc.

The heat sensitive recording sheet suitable for the purpose can be obtained by applying paper or various films with these coating colors.

The amount of dimethylterephthalate and the species and the amount of other ingredients to be incorporated in accordance with the present invention are not otherwise limited, but determined depending upon the performance and recording aptitude required for the specific heat sensitive recording sheet. However, in ordinary cases, it is suitable to use 3–10 parts by weight of organic color-developing agent, 1–5 parts by weight of dimethyl 1,4-benzenedicarboxylate and 1–20 parts by weight of filler per 1 part of weight of chromogenic dyestuff and to add 10–25 parts by weight of a binder per total solid content. Paper, film, foil, etc. may be used as the base sheet of the present invention.

Hereinafter, the present invention will be described further by way of typical examples of preferred embodiments thereof and by reference examples.

EXAMPLE 1

| | |
|---|---|
| Solution A (dispersion of dyestuff) | |
| 3-pyrrolidino-6-methyl-7-anilinofluoran | 1.5 parts |
| 10% aqueous solution of polyvinyl alcohol | 3.4 parts |
| water | 1.9 parts |
| Solution B (dispersion of color-developing agent) | |
| bisphenol A(4,4'-isopropylidene diphenol) | 6.0 parts |
| zinc stearate | 1.5 parts |
| 10% aqueous solution of polyvinyl alcohol | 18.8 parts |
| water | 11.2 parts |
| Solution C | |
| dimethyl 1,4-benzenedicarboxylate | 1.0 part |
| 10% aqueous solution of polyvinyl alcohol | 2.5 parts |
| water | 1.5 parts |

The solutions A, B and C of the above-mentioned composition were individually ground to a particle size of 3 microns by ball mill. Then, the dispersions were mixed in the following portions to prepare the coating colors.

| | Coating Colors | |
|---|---|---|
| | Example of the Present Invention | Reference Example |
| Solution A | 9.1 parts | 9.1 parts |
| Solution B | 37.5 parts | 37.5 parts |
| Solution C | 5.0 parts | 0 |
| Kaolin Clay (50% aqueous dispersion) | 10.0 parts | 10.0 parts |

The coating colors were applied on one side of a base paper weighing 50 g/m$^2$ at a coating weight of 6.0 g/m$^2$ and were then dried. The resultant papers were treated to a smoothness of 200–300 seconds by a supercalender. The obtained black-color-forming heat sensitive recording papers were tested for their quality and performance and the test results are shown in Table 1.

TABLE 1

| | Image Density at 120° C.(1) | Image Density after Contamination with Castor Oil(2) | Residual Ratio of Image Density after the Contamination(3) |
|---|---|---|---|
| Example of the Present Invention | 1.32 | 1.16 | 88% |
| Reference Example | 1.18 | 0.43 | 36% |

Note:
(1)The heat sensitive recording sheets are pressed down for 5 seconds under a pressure of 10 g/cm$^2$ on a hot plate heated to 120° C. and the optical density of the developed image is measured by a MacBeth densitometer RD-104.
(2)A castor oil (used as a base material of hair oil) is sucked up with an injector. A drop of castor oil is forced out from the injector to a forefinger and a spread on the forefinger and is transferred from the forefinger to the surface of the heat sensitive recording sheet which was colored at 120° C. The optical density of the image is measured by a MacBeth densitometer 48 hours after the contamination with the castor oil.
(3)Residual ratio of image density after the contamination =

$$\frac{\text{Image density after the contamination with castor oil}}{\text{Image density at 120° C.}} \times 100$$

As is obvious from Table 1, the Examples of the present invention containing dimethyl 1,4-benzenedicarboxylate has a residual ratio of image density of 88% and hence provides a relatively stable image for the contamination with a castor oil. On the contrary, the Reference Example without dimethyl 1,4-benzenedicarboxylate has a remarkable reduction in image density. Therefore, the present invention provides excellent effect against contamination with oily substances.

EXAMPLE 2

| | |
|---|---|
| Solution A (dispersion of dyestuff) | |
| 3-pyrrolidino-6-methyl-7-anilinofluoran | 1.5 parts |
| 10% aqueous solution of polyvinyl alcohol | 3.4 parts |
| water | 1.9 parts |
| Solution B (dispersion of color-developing agent) | |
| p-Hydroxybenzoic acid benzylester | 6.0 parts |
| zinc stearate | 1.5 parts |
| 10% aqueous solution of polyvinyl alcohol | 18.8 parts |
| water | 11.2 parts |
| Solution C | |
| dimethyl 1,4-benzenedicarboxylate | 1.0 parts |
| 10% aqueous solution of polyvinyl alcohol | 2.5 parts |
| water | 1.5 parts |

The solutions A, B and C of the above-described composition were individually ground to a particle size of 3 microns by an attritor. Then, the dispersions were mixed in the following proportions to prepare the coating colors.

| | Coating Colors | |
|---|---|---|
| | Example of the Present Invention | Reference Example |
| Solution A | 9.1 parts | 9.1 parts |
| Solution B | 37.5 parts | 37.5 parts |
| Solution C | 5.0 parts | 0 |
| Kaolin Clay (50% aqueous solution) | 10 parts | 10 parts |

The coating colors were applied to one side of a base paper weighing 50 g/m$^2$ at a coating weight of 6.0 g/m$^2$ and were then dried. The resultant papers were treated to a smoothness of 200–300 seconds by a supercalender. The obtained black-color-forming heat sensitive recording papers were tested for their quality and performance and the test results were shown in Table 2.

TABLE 2

| | Image Density at 120° C. | Image Density after Contamination with Castor Oil | Residual Ratio of Image Density after the Contamination |
|---|---|---|---|
| Example of the Present Invention | 1.28 | 0.96 | 75% |
| Reference Example | 1.20 | 0.58 | 48.3% |

As is obvious from Table 2, the heat sensitive recording paper using p-hydroxybenzoic acid benzylester as color-developing agent is remarkably high in the residual ratio of image density after the contamination with castor oil, in comparison to the Reference Example. Therefore, dimethyl 1,4-benzenedicarboxylate is very effective against contamination with the oily substances.

We claim:

1. Heat sensitive recording sheet with a color forming layer, characterized in that it comprises dimethyl 1,4-benzenedicarboxylate in said color-forming layer containing a basic colorless or pale-colored chromogenic dyestuff and an organic color-developing agent.

2. Heat sensitive recording sheet according to claim 1, wherein said organic color-developing agent is at least one phenolic substance.

3. Heat sensitive recording sheet according to claim 2, wherein said phenolic substance is are at least one substance selected from a group consisting of bisphenol A (4,4'-isopropylidene diphenol), p,p'-(1-methylnormalhexylidene) diphenol, p-tertiary butylphenol, p-phenylphenol and Novolak phenolic resin.

4. Heat sensitive recording sheet according to claim 1, wherein said organic color-developing agent is at least one phenolic substance.

5. Heat sensitive recording sheet according to claim 4, wherein said organic acid is at least one p-Hydroxybenzoic acid ester.

6. Heat sensitive recording sheet according to claim 1, wherein said colorless or pale-colored chromogenic dyestuff is at least one substance selected from a group consisting of crystal violet lactone, 3-diethylamino-6-methyl-7-anilinofluoran, 3-(n-ethyl-p-toluidino)-6-methyl-7-anilinofluoran, 3-diethylamino-6-methyl-7-(o, p-dimethylanilino) fluoran, 3-pyrrolidino-6-methyl-7-anilino-fluoran, 3-piperidino-6-methyl-7-anilinofluoran, 3-(n-cyclohexyl-n-methylamino)-6-methyl-7-anilinofluoran, 3-diethylamino-7-(o-chloro-anilino) fluoran, 3-diethylamino-7-(m-trifluoromethylanilino) fluoran, 3-diethyl-amino-6-methylchlorofluoran, 3-diethylamino-6-methylfluoran and 3-cyclohexylamino-6-chlorofluoran.

7. Heat sensitive recording sheet according to claim 1, wherein said color-forming layer contains 3–10 parts by weight of said organic color-developing agent, 1–15 parts by weight of dimethyl 1,4-benzenedicarboxylate and 1–20 parts by weight of filler per 1 part by weight of a chromogenic dyestuff and 10–25 parts by weight of a binder per total solid content thereof.

8. Heat sensitive recording sheet according to claim 1, wherein said base sheet is paper.

* * * * *